US007363216B2

(12) United States Patent
Absar et al.

(10) Patent No.: US 7,363,216 B2
(45) Date of Patent: Apr. 22, 2008

(54) METHOD AND SYSTEM FOR PARAMETRIC CHARACTERIZATION OF TRANSIENT AUDIO SIGNALS

(75) Inventors: Mohammed Javed Absar, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 801 days.

(21) Appl. No.: 10/626,845

(22) Filed: Jul. 23, 2003

(65) Prior Publication Data

US 2004/0138886 A1 Jul. 15, 2004

(30) Foreign Application Priority Data

Jul. 24, 2002 (SG) ..... 200204487

(51) Int. Cl.
*G10L 19/14* (2006.01)
*G10L 19/00* (2006.01)

(52) U.S. Cl. ..... 704/205; 704/501

(58) Field of Classification Search ..... None
See application file for complete search history.

(56) References Cited

U.S. PATENT DOCUMENTS 4,935,963 A * 6/1990 Jain ..... 704/207
5,665,928 A * 9/1997 Wang ..... 84/621
5,884,253 A * 3/1999 Kleijn ..... 704/223
6,266,644 B1 * 7/2001 Levine ..... 704/503
6,862,558 B2 * 3/2005 Huang ..... 702/194
6,925,434 B2 * 8/2005 Oomen et al. ..... 704/206
7,020,615 B2 * 3/2006 Vafin et al. ..... 704/500

OTHER PUBLICATIONS

Purnhagen et al., "Object-Based Analysis/Synthesis Audio Coder for Very Low Bit Rates", AES 104th Convention, Apr. 1998.*
Edler et al., "ASAC-Analysis/Synthesis Audio Codec for Very Low-Bit Rates", AES 100th Convention, Apr. 1996.*
Le, "A spline smoothing approach to transient signal reconstruction", IEEE Proceedings of Southeastcon '91, Apr. 7-10, 1991, pp. 1040-1044, vol. 2.*
Oppenheim et al., "Discrete-Time Signal Processing, 2nd Edition", Prentice Hall, 1999, pp. 629-630.*
Goodwin, Michael M., "Adaptive Signal Models: Theory, Algorithms, and Audio Applications," Ph.D. Thesis, University of California, Berkeley, 1997.

(Continued)

*Primary Examiner*—David Hudspeth
*Assistant Examiner*—B Albertalli
(74) *Attorney, Agent, or Firm*—Lisa K. Jorgenson; Timothy L. Boller; Seed IP Law Group PLLC

(57) ABSTRACT

A method of parametrically encoding a transient audio signal, including the steps of: determining a set V of the N largest frequency components of the transient audio signal, where N is a predetermined number; determining an approximate envelope of the transient audio signal; and determining a predetermined number P of samples W of the approximate envelope for use in generating a spline approximation of the approximate envelope, whereby a parametric representation of the transient audio signal is given by parameters including V, N, P and W, such that a decoder receiving the parametric representation can reproduce a received approximation of the transient audio signal.

25 Claims, 8 Drawing Sheets

OTHER PUBLICATIONS

Goodwin, Michael M., "Matching Pursuit with Damped Sinusoids," in *Proceedings of the IEEE International Conference on Acoustics, Speech and Signal Processing*, 1997, pp. 2037-2040.

Purnhagen, H. et al., "HILN—The MPEG-4 Parametric Audio Coding Tools," in *Proceedings of the IEEE International Symposium on Circuits and Systems*, Geneva, Switzerland, May 28-31, 2000, pp. III-201-III-204.

Purnhagen, H., "Advances in Parametric Audio Coding," in *Proceedings of the 1999 IEEE Workshop on Applications of Signal Processing to Audio and Acoustics*, New Paltz, New York, Oct. 17-20, 1999, pp. 31-34.

* cited by examiner

METHOD AND SYSTEM FOR PARAMETRIC CHARACTERIZATION OF TRANSIENT AUDIO SIGNALS

FIELD OF THE INVENTION

The present invention relates to methods and systems for parametric characterization and modeling of transient audio signals for encoding thereof. This invention is particularly useful in the area of digital audio compression at very low bit-rates.

BACKGROUND OF THE INVENTION

The MPEG-4 parametric audio coding tools 'Harmonic and Individual Lines plus Noise' (HILN) permit coding of general audio signals at bit-rates of 4 kbps and above using a parametric representation of the audio signals (please see Heiko Purnhagen, *HILN-The MPEG-4 Parametric Audio Coding Tools*, IEEE International Conference on Circuits and Systems, May 2000 and Heiko Purnhagen, *Advances in Parametric Audio Coding*, IEEE Workshop on Applications of Signal Processing to Audio and Acoustics, October 1999). FIG. 1 shows a block diagram of a HILN parametric audio encoder. The input signal is first decomposed into different components and then the model parameters for the components' source models are estimated such that:

- An individual sinusoid is described by its frequency and amplitude.
- A harmonic tone is described by its fundamental frequency, amplitude and the spectral envelope of its partial harmonics.
- A noise_signal is described by its amplitude and spectral envelope.

Due to the low target bit rates (e.g. 6-16 kbps), only the parameters for a small number of components can be transmitted. Therefore a perception model is employed to select those components that are most important for the perceptual quality of the signal. The quantization of the selected components is also done using the perceptual importance criteria.

A slightly different approach was adapted by Goodwin (M. Goodwin, *Adaptive Signal Models: Theory, Algorithm and Audio Applications*, PhD thesis, University of California, Berkeley, 1997) for the atomic decomposition of audio signals. Consider an additive signal model of the form:

$$x[n] = \sum_{i=1}^{I} a_i g_i[n]$$

wherein a signal is represented as a weighted sum of basic components ($g_i[n]$). These building blocks or basic components are picked from an existing dictionary of many such components. Being over-complete, it is possible to represent the same signal with non-identical sets of basic components. The preferred representation set chosen will be the one in which there are the fewest number of basic components. This is the concept of compact representation, and is the theme behind most advanced signal representation techniques such as wavelets. The traditional transform coders that use a set of complex exponentials (analogous to words in the dictionary) as the basis for encoding input signals are complete. Therefore there is only one possible representation of enclosed signal because there is a unique Fourier Transform for a given signal. In the over-complete case, more than one representation is possible, and an efficient coding scheme attempts to determine which is most compact.

Sinusoidal modeling is suited best for stationary tonal signals. Transient signals (such as beats) can be modeled well only by using a large number of such sinusoids with the original phase preserved, as presented by Pumhagen in *Advances in Parametric Audio Coding*. This is certainly not a compact representation of transient signals.

Goodwin [M. Goodwin, *Matching Pursuit with Damped Sinusoids*, IEEE International Conference on Acoustics, Speech and Signal Processing, 1997] recommended the scheme of damped sinusoids to model transients. However, his approach of matching pursuit is relatively computationally expensive. It is desired to provide a simpler approach that produces good results.

Moreover, the general thinking seems to be that the decay in the transient signal is modeled as a single exponential. FIG. 2 shows, however, that the envelope generated by the single exponential has significant error relative to the true envelope. Accordingly, the single exponential model is not desirably accurate. For a small increase in the number of parameters, it is possible to be more accurate about the exact nature of the decay function.

SUMMARY OF THE INVENTION

The present invention provides a system and method of parametrically encoding a transient audio signal. In one embodiment, the method includes the steps of:

(a) determining a set of frequency values V of the N largest frequency components of the transient audio signal, where N is a predetermined number;

(b) determining an approximate envelope of the transient audio signal; and (c) determining a predetermined number P of amplitude values of W of samples of the approximate envelope for use in generating a spline approximation of the approximate envelope;

whereby a parametric representation of the transient audio signal is given by parameters including V, N, P and W, such that a decoder receiving the parametric representation can reproduce a decoder approximation of the transient audio signal.

Preferably, the method further includes the steps of:

(d) generating a spline approximation of the approximate envelope using a spline interpolation function and the predetermined number P of samples W;

(e) generating an encoder-side approximation of the transient audio signal based on the spline approximation and the parameters V, N, P and W;

(f) determining energy levels of the encoder-side approximation and the transient audio signal, respectively; and (g) determining a scaling factor as a function of the energy levels of the encoder-side approximation and the transient audio signal for scaling the received approximation to match an energy level thereof with the energy level of the transient audio signal.

Preferably, the spline interpolation function is a cubic spline interpolation function. Preferably, N is determined according to a bit rate of an audio encoder performing the method.

Preferably, step (a) includes determining frequency components of the transient audio signal by performing a fast Fourier transform thereof and selecting the N largest frequency components of the determined frequency components. Preferably, step (b) includes determining an absolute value version of the transient audio signal and low pass filtering the absolute value version to generate an envelope. Preferably, the method further includes scaling the decoder approximation to match an energy level thereof with an energy level of the transient audio signal.

One embodiment of the invention provides an encoder adapted to perform the method as described above. Another embodiment of the invention provides a decoder adapted to decode a signal having a transient audio signal encoded according to the method described above.

Another embodiment provides a system for parametrically encoding a transient audio signal and has means for determining a set of frequency values V of the N largest frequency components of the transient audio signal, where N is a predetermined number, means for determining an approximate envelope of the transient audio signal, means for determining a predetermined number P of amplitude values W of samples of the approximate envelope for use in generating a spline approximation of the approximate envelope, and means for transmitting a parametric representation of the transient audio signal comprising parameters including V, N, P and W, such that a decoder receiving the parametric representation can reproduce a decoder approximation of the transient audio signal.

The present invention provides an improvement on the method of damped sinusoids. Instead of modeling the damping simply as an exponential ($e^{-k\alpha}$) with parameter k, we first derive a smooth envelope of the signal and then subsequently use spline interpolation functions (preferably cubic) to approximate the envelope of the transient audio signal.

In the matching pursuit algorithm proposed by Goodwin, damped sinusoids are matched against the residue signal in an iterative manner. In the present approach, a set of N highest un-damped sinusoids (which are found directly from the spectrum of the signal) are used to generate an approximation of the transient signal and then a cubic-spline interpolated envelope is imposed onto the sinusoids. Therefore the present approach is much simpler.

In one embodiment, the transient modeling begins with the classification of a segment of an audio signal (of length, say I) as transient. The Fast Fourier Transform of the segment x[n] is then computed to determine the frequency coefficients X[k]:

$$X[k] = \sum_{i=1}^{i} x[n]e^{-j\frac{2\pi nk}{I}} \qquad k = 0 \ldots I/2\text{-}1$$

Next, a set V of N indices is formed such that: for each $v \in V$, $0 <= v < I/2$ and $\|X[v]\| >= \|X[w]\|$, where $w \notin V$. In other words, V contains those indices that correspond to the N largest frequency components. The first approximation of the signal x[n] is:

$$\hat{x}[n] = \sum_{k \in V} \left( \mathrm{real}(X[k])\cos\left(\frac{2\pi nk}{I}\right) - \mathrm{imag}(X[k])\sin\left(\frac{2\pi nk}{I}\right) \right)$$

where X[k] are frequency coefficients of x[n] for k=1, 2, . . . , N.

Next, a new signal $x_{abs}[n]=\|x[n]\|$ is derived. A low-pass filtering of the signal $x_{abs}[n]$ is performed with the filter $H(z)=1+z^{-1}+z^{-2} \ldots z^{-M}$, where M is the order of the filter plus one. The resultant filtered signal $x_{env}[n]$ is taken as a good approximation of the envelope of signal x[n]. Using P equidistant points W on $x_{env}[n]$, a cubic-spline interpolation is performed to derive an approximation s[n] of the signal envelope. The spline is imposed onto the approximate signal $\hat{x}[n]$, i.e. $y[n]=\hat{x}[n]*s[n]$. A scale-factor $\alpha$ is computed to match the energy of the reconstructed signal with the original signal. The parameters describing the transient x[n] are then: I, V, X[k] (for each $k \in V$), W and $\alpha$.

Advantageously, embodiments of the invention enable the transient audio signal to be more accurately reproduced at the decoder side.

BRIEF DESCRIPTION OF THE DRAWINGS

FIGS. 4(*b*), (*c*) and (*d*) show progressive summing of sinusoidal signals to arrive at a modeled version of the transient audio signal in FIG. 4(*e*);

A detailed description of preferred embodiments of the invention is hereinafter provided, by way of example only, with reference to the accompanying drawings.

DETAILED DESCRIPTION OF THE PREFERRED EMBODIMENTS

Consider a segment of audio signal that has been classified as transient. Several approaches exist for detecting a transient, the most popular one being the Spectral Flatness Measure or SFM. In the SFM method, the ratio of the geometric mean to the arithmetic mean of the spectral values is computed. A high SFM ratio implies a flatter spectrum and is more akin to an attack or transient. Smooth periodic signals, which are predominantly composed of a fundamental frequency and a few harmonics, result in a spiky spectrum and a small SFM value.

Figure 1:
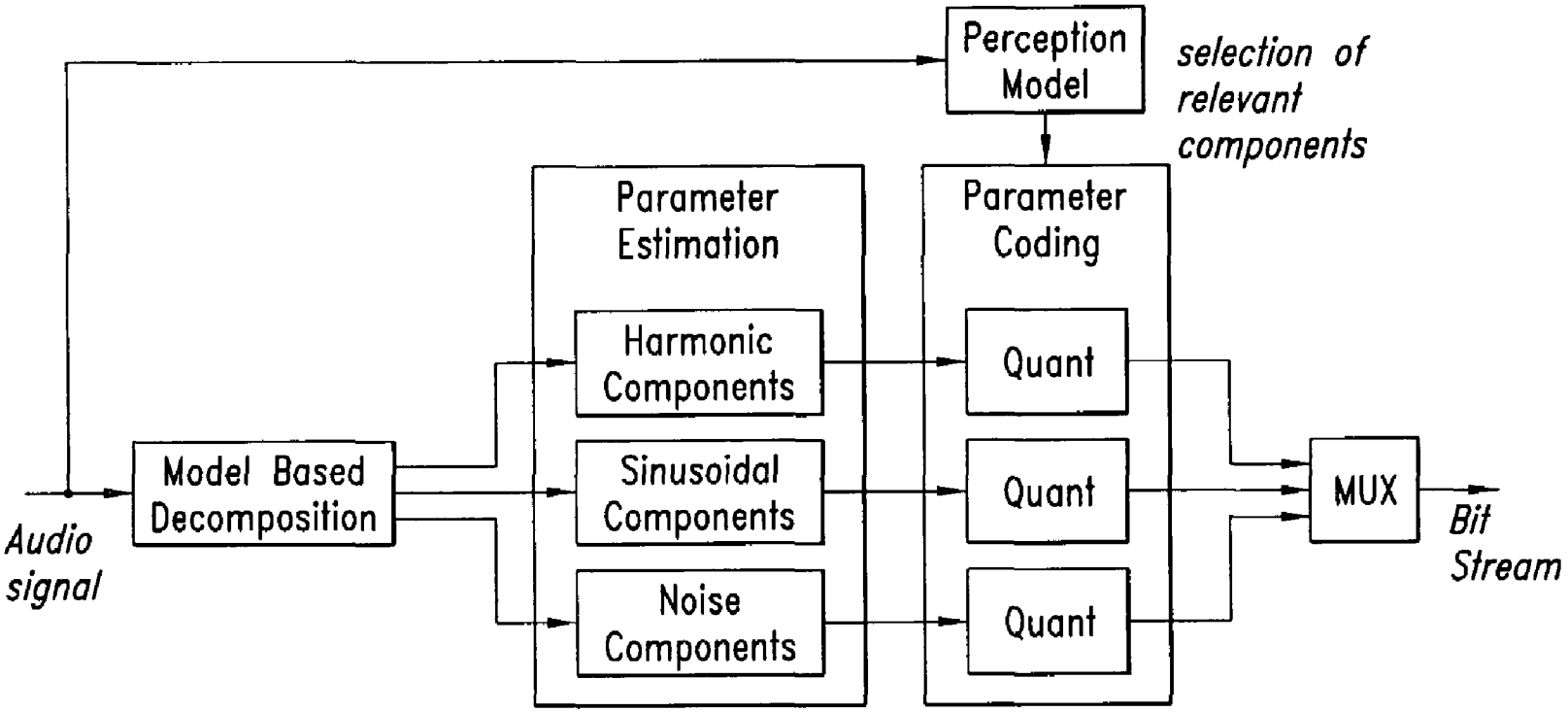
FIG. 1 (Prior Art)
FIG. 1 is a block diagram of the HILN parametric audio encoder model.
Figure 2:
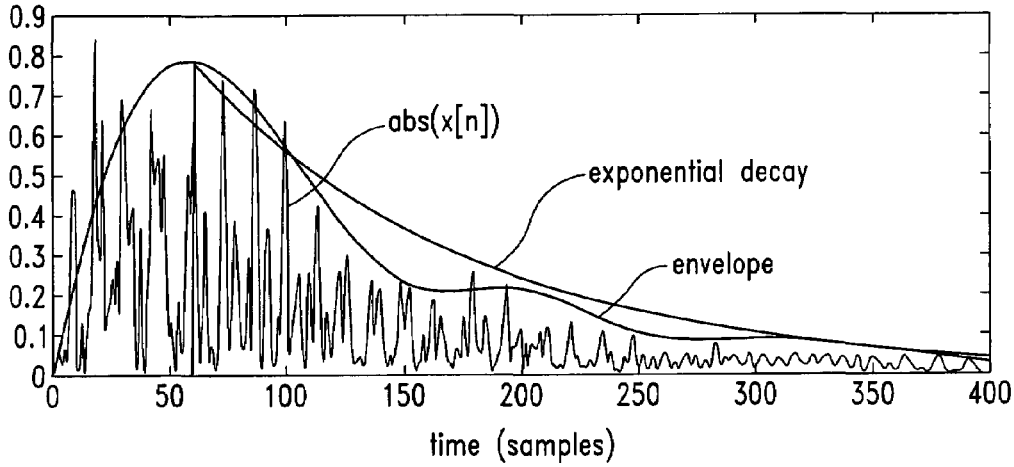
FIG. 2 (Prior Art)
FIG. 2 is a comparative plot, showing the absolute value of a transient signal, its approximate envelope and the closest exponential decay function approximating the decay of the transient audio signal over time.
Figure 3:
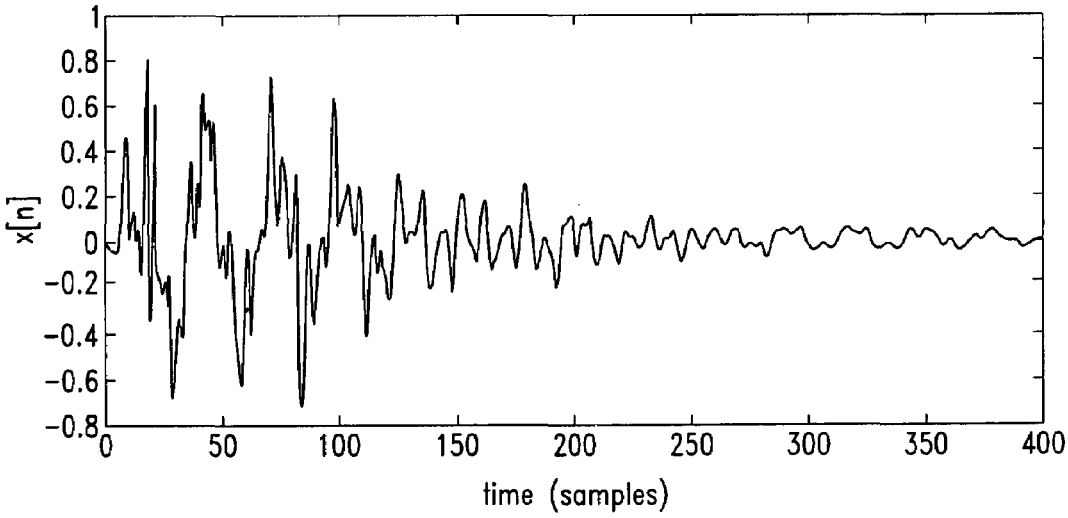
FIG. 3 shows an example of a transient audio signal, x[n]
Figure 4A:
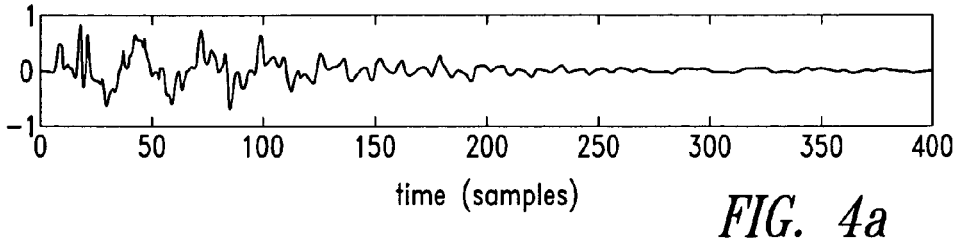
FIG. 4(*a*) shows the transient audio signal of FIG. 3.
Figure 4B:
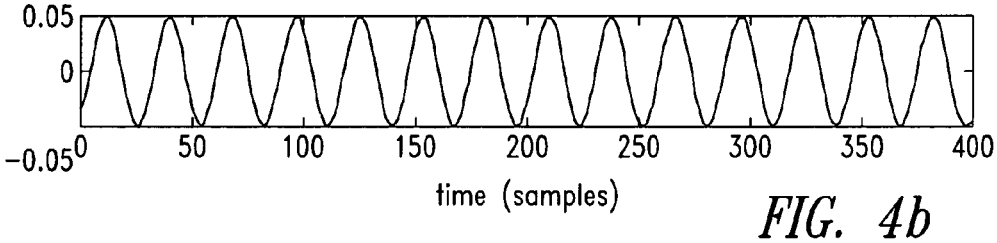
Figure 4C:
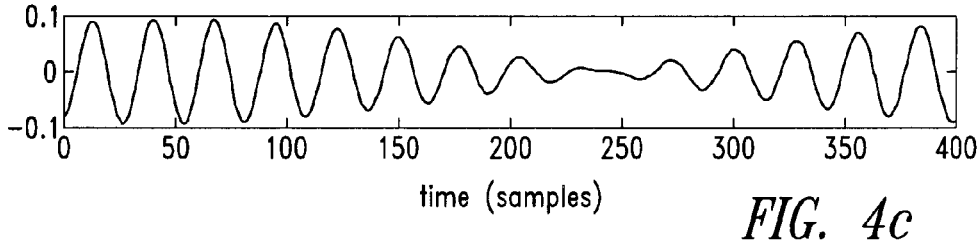
Figure 4D:
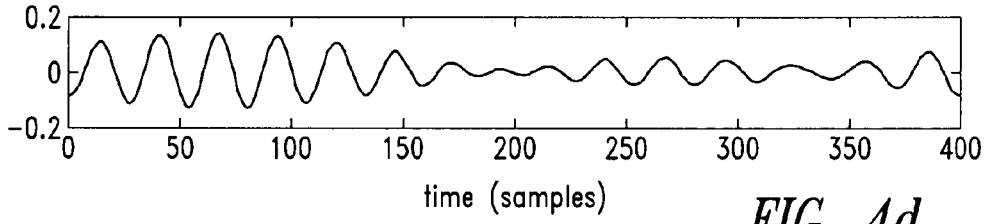
Figure 4E:
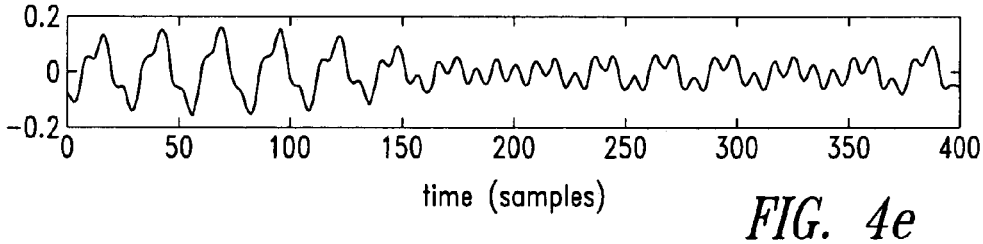

FIG. 3 shows the time domain samples of a castanet, which is a classic example of a transient-type signal. Before the onset of the transient is a period of quiet, and after a very brief period of pseudo-periodic activity (transient), the music decays quickly in a somewhat exponential manner.

In order to parameterize this transient signal, we identify the basic components that constitute this signal. In Goodwin's approach, one would seek to identify damped sinusoids (each with an amplitude, frequency and decay factor) the sum of which form a close approximation of the given signal. As mentioned, this approach is quite computationally expensive. In an embodiment of the invention, a Discrete Fourier Transform or its faster equivalent, the Fast Fourier Transform (FFT), is used to determine the main frequency components of the signal. Let X[k] be the frequency coefficients obtained after performing an FFT on signal x[n].

$$X[k] = \sum_{i=1}^{I} x[n]e^{-j\frac{2\pi nk}{I}}$$

Next we construct a set V of indices in the following manner. Choose $k_1$ such that $\|X[k_1]\|$ has the largest value over all k=0 . . . I/2−1 for a signal interval I. Add $k_1$ to V. Now choose $k_2$ such that $\|X[k_2]\|$ has the largest value (excluding $k_1$). Continue in this manner to add indices to V. The number N of elements in V depends on the compression rate (the lower the bit-rate, the fewer the elements). An approximation of the signal x[n] is given by:

$$\hat{x}[n] = \sum_{k\in V}\left(\text{real}(X[k])\cos\left(\frac{2\pi nk}{I}\right) - \text{imag}(X[k])\sin\left(\frac{2\pi nk}{I}\right)\right)$$

This approximation is used on the decoder side to reconstruct the original transient signal from its major constituent frequency components. The reconstruction accuracy depends on the number of elements in V. However, for very low bit-rates, not many components can be transmitted.

FIG. 4 shows the reconstruction of x[n] using the above principle. Plot (a) shows the original transient signal. Plots (b), (c), (d) show the progressive summing of sinusoidal signals to arrive at an approximation of the original signal, shown as plot (e). Note the considerable ringing in the latter part of the reconstructed signal in plot (e). This ringing is undesirable as it introduces an additional damping effect which reduces the sharpness of the reproduced transient signal. With the three sinusoids summed as illustrated in FIG. 4, a rough approximation of the transient is obtained. However, a considerable problem is that the reconstructed signal does not decay as much as the original, due to the ringing.

Figure 5:
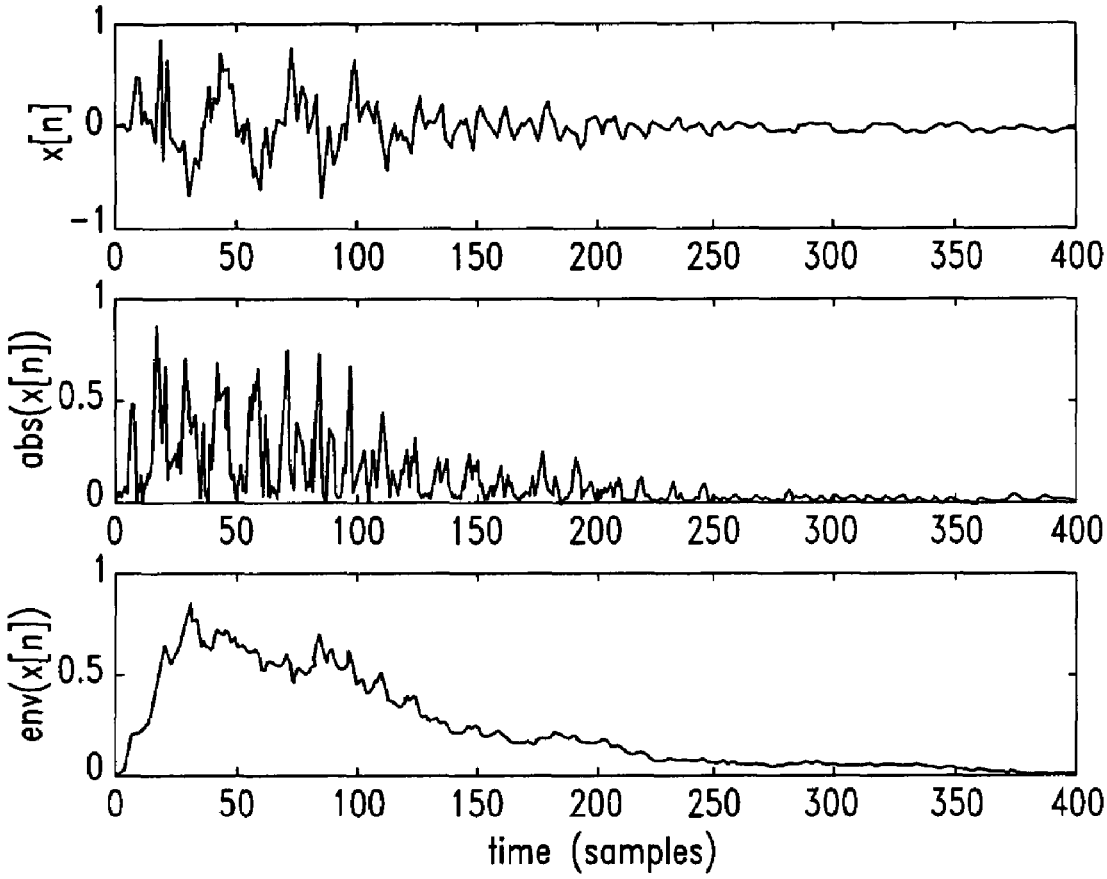
FIG. 5 shows comparative plots of the original transient audio signal, an absolute value version thereof and an envelope thereof.

To model the decay function, an envelope of the signal must be determined. A reasonable way of obtaining the envelope is proposed here. Given the signal x[n], an absolute magnitude version of the signal $x_{abs}[n]=\|x[n]\|$ is derived. Following this, a low pass filtering of the absolute signal $x_{abs}[n]$ with the filter $H(z)=1+z^{-1}+z^{-2} \ldots z^{-M}$ is performed, where M is the order of the filter plus one. The low pass filtering removes short-term fluctuations and so generates a kind of envelope $x_{env}[n]$ of the signal. FIG. 5 shows plots of $x_{abs}[n]$ and $x_{env}[n]$ obtained from example signal x[n]. The filter used to generate $x_{env}[n]$ in FIG. 5 is of order 20 (M=21).

An embodiment of the invention parameterizes the envelope so that it can be described to the decoder at the receiver with few parameters. This embodiment models the envelope obtained through low pass filtering of the signal accurately and yet in a compact form.

The envelope is interpolated using a spline function. Sample points are determined between which the envelope is to be interpolated by taking a predetermined number P of samples W over the interval I of the transient signal. The samples W are equally spaced over time within the interval I and include the first and last samples thereof. The number P of samples W is determined, as an operational parameter, depending on the desired decoder reproduction accuracy. In the example shown in FIG. 6, P is 9.

Spline functions are important and powerful tools for a number of approximation tasks such as interpolation, data fitting and the solution of boundary value problems for differential equations.

In general, given sample points $\{x_j\}_{j=0}^{n}$, a function s belongs to the set $\hat{S}_m(x_0, \ldots, x_n)$ of spline functions of degree m over (n+1) points $x_0, \ldots, x_n$ if 1. s is a polynomial of degree at-most m in each of the intervals $]-\infty,x_0[x_0,x_1[, \ldots ,]x_n,\infty[$.
2. s and its first m−1 derivatives vary continuously over the points $x_0, \ldots, x_n$ $$s^{(p)}(x_{i-}) = s^{(p)}(x_i+), \left\{\frac{p = 0, 1, \ldots, m-1}{i = 0, 1, \ldots n}\right.$$

Figure 6:
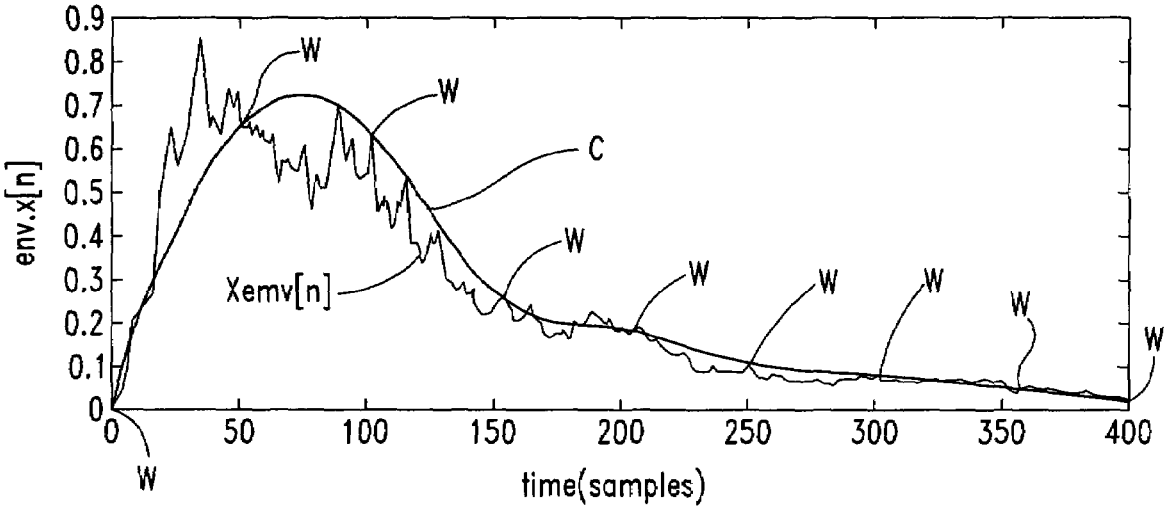
FIG. 6 is a plot of the envelope shown in FIG. 5, with a cubic spline approximation of the envelope overlayed thereon.
Figure 7A:
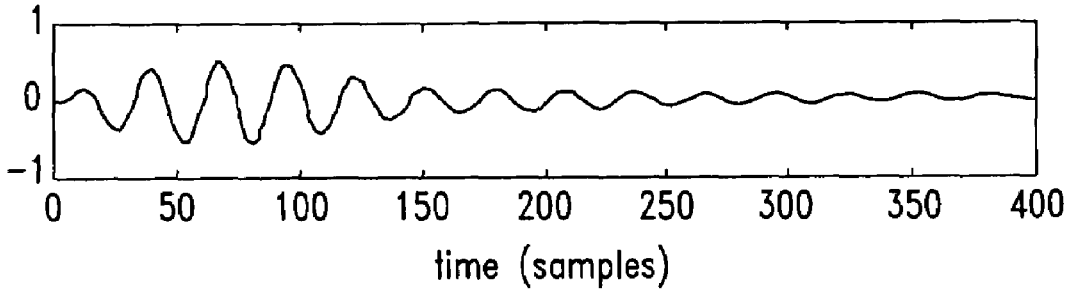
FIG. 7 shows the plots of FIGS. 4(*b*), (*c*), (*d*) and (*e*), but with the cubic spline-derived envelope imposed thereon, resulting in plots 7(*a*), (*b*), (*c*) and (*d*)
Figure 7B:
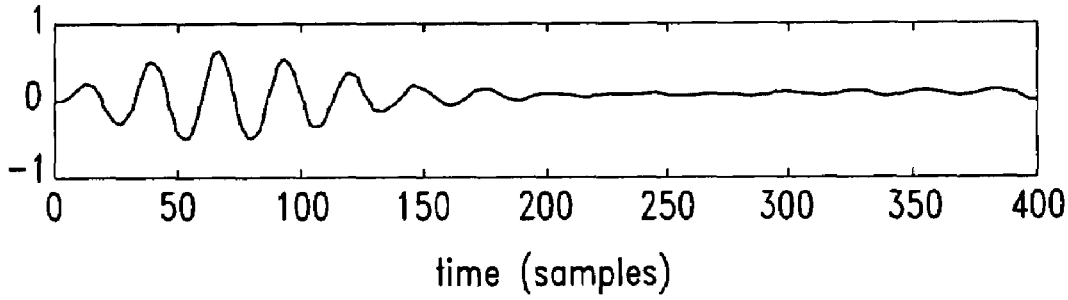
Figure 7C:
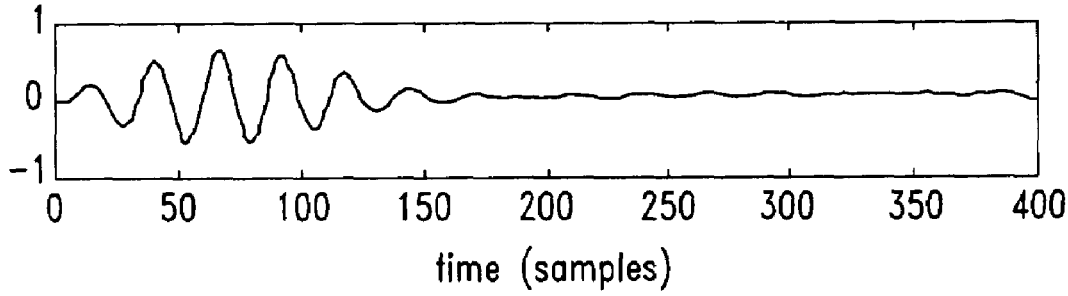
Figure 7D:
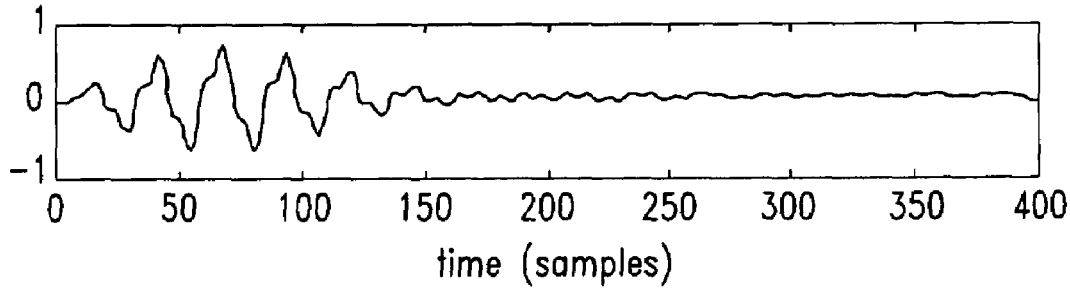

Generally, s is a piecewise polynomial, i.e. a new polynomial in each sub-interval, and these polynomials are glued together. Since any two adjacent ones of these piecewise polynomials and their first m−1 derivatives $s^{(p)}$ (.) vary continuously at the intervals, the overall effect is a virtually smooth continuous function. The value of m can be as large as necessary, however m=3 (cubic) is preferably used here since this degree gives a sufficiently smooth curve. FIG. 6 shows a spline-derived envelope approximation (C) of $x_{env}[n]$ constructed using nine equidistant points (W) on the envelope $x_{env}[n]$.

Imposing the spline function s[n] over the previously reconstructed transient signal $\hat{x}[n]$, a better approximation $y[n]=\hat{x}[n]*s[n]$ of the original signal is obtained. This approximation is better because the sinusoids, as such, are not damped, but rather a spline function is used to shape the sinusoids according to the signal envelope. Finally, an amplitude adjustment (scale) factor $\alpha$ is used to adjust the energy of the reconstructed signal to that of the original signal. This adjustment is determined from the ratio between the energy of the original transient signal to that of the modeled transient signal at the encoder side signal.

Figure 8:
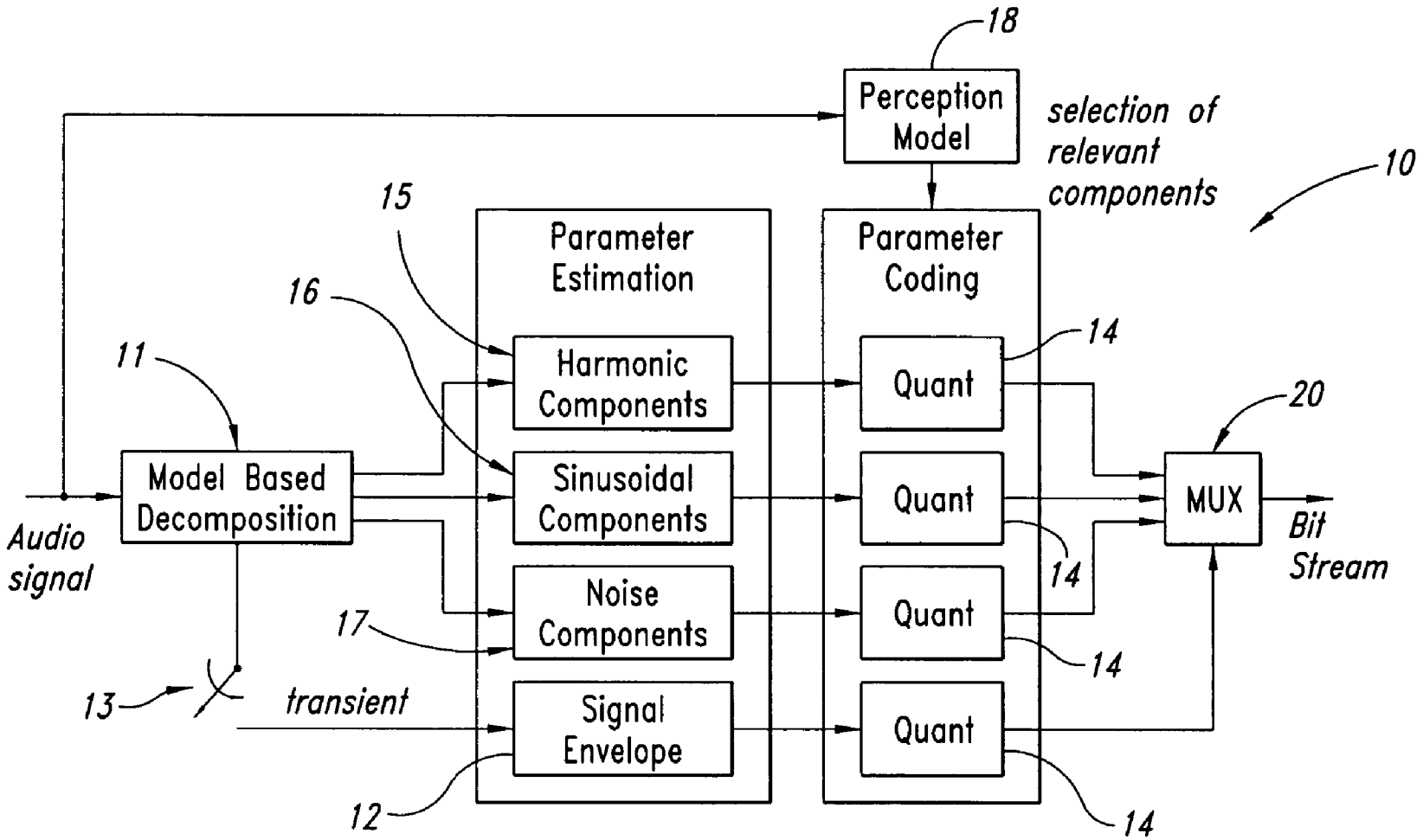
FIG. 8 is a block diagram of an improved HILN model encoder according to an embodiment of the invention.

FIG. 8 is a block diagram of a model of an encoder 10 according to an embodiment of the invention. The encoder 10 improves on the standard HILN model by adding a signal envelope generation module 12 as part of the parameter estimation block. An additional quantizer 14 is provided at the output of the signal envelope generation module 12 as part of the parameter coding block, and the output of the quantizer 14 is fed into the multiplexer 20. The encoder 10 assumes detection of an interval of the audio signal as being transient, after which the signal interval is fed into the signal envelope generation module 12, by closing switch 13, for parameterization thereof according to the method described above. A model based decomposition module 11 within the encoder 10 determines whether the incoming audio signal is to be classified as tonal, transient or noise, according to known methods, as well as determining the fast fourier transform of the input audio signal.

For the embodiment shown in FIG. 8, parameter estimation is performed for harmonic components (block 15) and noise components (block 17), as well as sinusoidal components (block 16). Once the input audio signal is determined by the module based decomposition module 11 to be transient, parameter estimation, of the harmonic and noise components in blocks 15, 17 is not required. A perception model module 18 selects the relevant components to be quantified. Sinusoidal components block 16 determines the N largest components (represented by the set V) of the input audio signal and these are passed through a quantizer to multiplexer 20.

The signal envelope generation module 12 receives the input audio signal x[n] and determines the envelope thereof by low pass filtering an absolute value version of the input signal. The signal envelope generation module 12 then determines P equidistant points W on the envelope and determines a spline interpolation of the envelope based on those P points. The signal envelope generation module 12 also computes the scale factor α, and the determined envelope parameters, including points W, are quantized and transmitted, along with the scale factor α, via multiplexer 20. This information, together with the N quantized values of set V transmitted through the sinusoidal components block 16, is used by the decoder (shown in FIG. 9) to reconstruct the transient audio signal.

Figure 9:
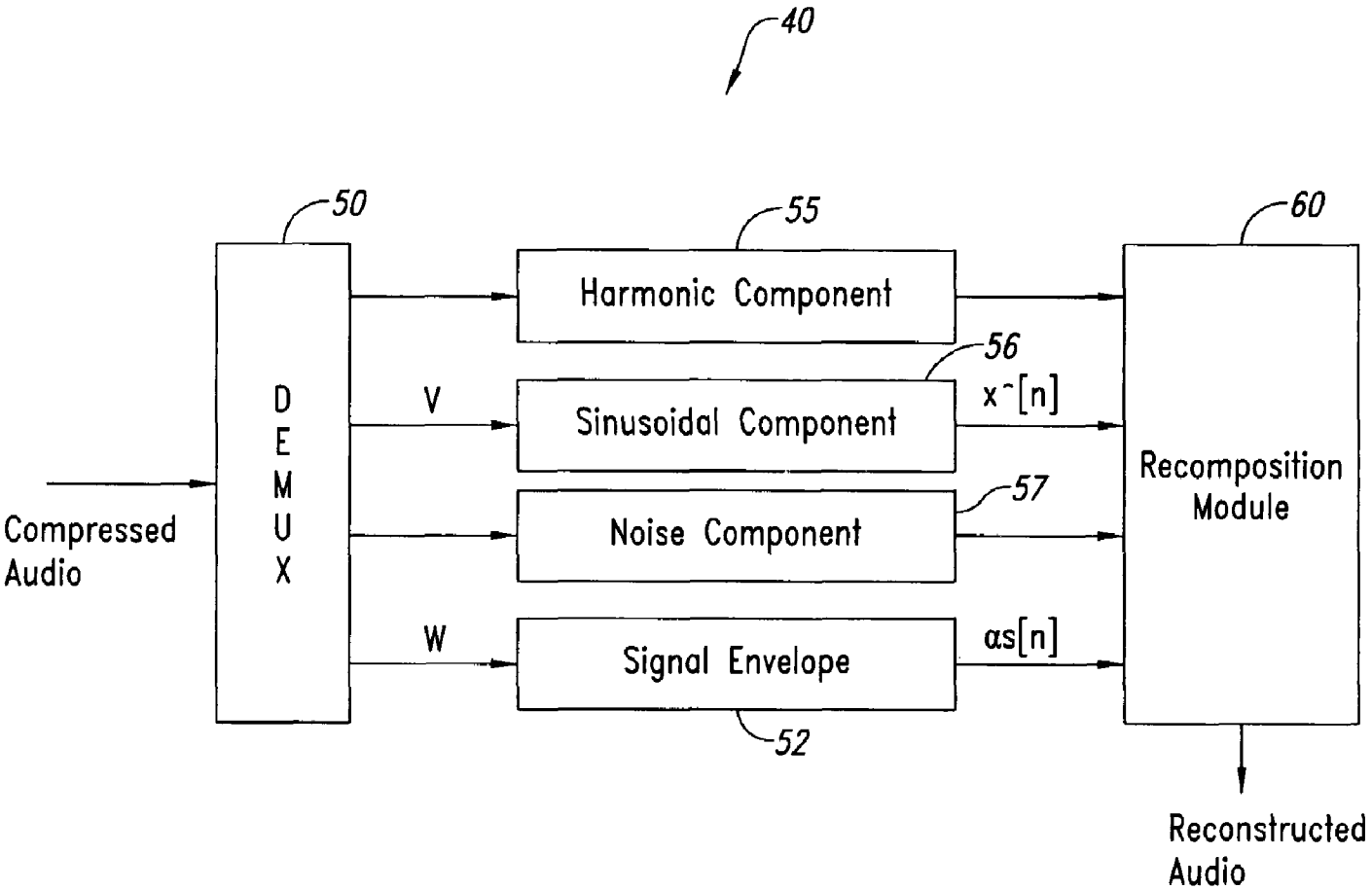
FIG. 9 is a block diagram of a decoder according to another embodiment of the invention.

Referring now to FIG. 9, a decoder 40 is provided for receiving and decoding compressed audio data which has been encoded by the encoder 10 shown in FIG. 8. The decoder 40 has a demultiplexer 50 for decompressing the received audio data and directing it to harmonic, sinusoidal and noise component decoder modules 55, 56 and 57 and to signal envelope reconstruction module 52. Alternatively, the compressed audio data may be decompressed in a separate step before it is received by the demultiplexer. The set V of N harmonics is used by the sinusoidal component module 56 to generate an approximation of the signal x^[n], as described above, thereby outputting an approximation x^[n].

The signal envelope reconstruction module 52 receives the envelope information, including points W and scale factor α, to generate a scaled cubic spline function s[n] which, in combination with the signal approximation x^[n], is used by the reconstruction module 60 to reconstruct the transient audio signal. The final reconstructed signal is represented by $\alpha\hat{x}[n]*x[n]$.

The steps and modules described herein and depicted in the drawings may be performed or constructed in either hardware or software or a combination of both, the implementation of which will be apparent to those skilled in the art from the preceding description of the invention and the drawings. Certain modifications may be made to the hereinbefore described embodiments of the invention without departing from the spirit and scope of the invention, and these will be apparent to persons skilled in the art.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method of parametrically encoding a transient audio signal, the method comprising:

(a) determining a set of frequency values V for N largest frequency components of the transient audio signal, where N is a selected number;

(b) determining an approximate envelope of the transient audio signal;

(c) determining a selected number P of amplitude values W of samples of the approximate envelope;

(d) generating a spline approximation of the approximate envelope using a spline interpolation function and the amplitude values W; and (e) generating an encoder approximation of the transient audio signal based on the spline approximation, the set of frequency values V, the number N, the number P and the amplitude values W, whereby a parametric representation of the transient audio signal is given by parameters including V, N, P and W, such that a decoder receiving the parametric representation can reproduce a decoder approximation of the transient audio signal.

2. The method of claim 1, further comprising:

determining energy levels of the encoder approximation and the transient audio signal, respectively; and determining a scaling factor as a function of the energy levels of the encoder approximation and the transient audio signal for scaling the decoder approximation with the energy level of the transient audio signal.

3. The method of claim 1, further comprising transmitting the parametric representation of the transient audio signal via a communication medium.

4. The method of claim 1, wherein the spline interpolation function is a cubic spline interpolation function.

5. The method of claim 1, wherein N is determined according to a bit rate of an audio encoder performing the method.

6. The method of claim 1, wherein step (a) includes:

determining a set of frequency components of the transient audio signal by performing a fast Fourier transform thereof, and selecting N largest frequency components of the set of determined frequency components.

7. The method of claim 1, further comprising determining an interval, I, of the transient audio signal and wherein the parameters of the parametric representation further include the interval I.

8. The method of claim 7, wherein the samples W are equally spaced in time over the interval I.

9. The method of claim 1, wherein a received approximation of the transient audio signal x[n] is given by:

$$\hat{x}[n] = \sum_{k \in V} \left( \mathrm{real}(X[k]) \cos\left(\frac{2\pi nk}{I}\right) - \mathrm{imag}(X[k]) \sin\left(\frac{2\pi nk}{I}\right) \right)$$

where X[k] are frequency coefficients of x[n] for k=1, 2, . . . , N; and

I is the interval of the transient audio signal.

10. The method of claim 1, wherein step (b) includes:

determining an absolute value version $x_{abs}[n]$ of the transient audio signal x[n]; and low-pass filtering the absolute value version $x_{abs}[n]$ to generate the approximate envelope $x_{env}[n]$.

11. The method of claim 1 wherein N and P are predetermined numbers.

12. An encoder, the encoder comprising:

means for determining a set of frequency values V for N largest frequency components of a transient audio signal, where N is a selected number;

means for determining an approximate envelope of the transient audio signal;

means for determining a selected number P of amplitude values W of samples of the approximate envelope;

means for generating a spline approximation of the approximate envelope using a spline interpolation function and the amplitude values W; and means for generating an encoder approximation of the transient audio signal based on the spline approximation, the set of frequency values V, the number N, the number P and the amplitude values W.

13. The encoder of claim 12 wherein N and P are predetermined numbers.

14. A system for parametrically encoding a transient audio signal, the system comprising:

means for determining a set of frequency values V of N largest frequency components of the transient audio signal, where N is a predetermined number;

means for determining an approximate envelope of the transient audio signal;

means for determining a predetermined number P of amplitude values W of samples of the approximate envelope;

means for generating a spline approximation of the approximate envelope using a spline interpolation function and the amplitude values W;

means for generating an encoder approximation of the transient audio signal based on the spline approximation, the set of frequency values V, the number N, the number P and the amplitude values W;

means for transmitting a parametric representation of the transient audio signal comprising a set of parameters, the parameters including V, N, P and W, such that a decoder receiving the parametric representation can reproduce a decoder approximation of the transient audio signal.

15. A signal encoder, the encoder comprising:

a sinusoidal component estimator configured to estimate a set of values V for a number N of sinusoidal components of a signal;

a sinusoidal component quantifier coupled to the sinusoidal component estimator;

a signal envelope estimator configured to generate an estimated signal envelope of the signal and a set of values W for a number P of samples of the estimated signal envelope;

a signal envelope quantifier coupled to the signal envelope parameter estimator and configured to generate an encoder approximation of the signal based on a spline approximation of the estimated signal envelope; and a multiplexer coupled to the sinusoidal component quantifier and the signal envelope quantifier and configured to generate an encoded data stream, the encoded data stream including the values V and W.

16. The encoder of claim 15 wherein the signal envelope estimator determines an energy scaling factor.

17. A method of encoding a signal, the method comprising:

(a) determining a set of frequency values V for N frequency components of the signal, where N is a selected number;

(b) determining an approximate envelope of the signal;

(c) determining a selected number P of amplitude values W of samples of the approximate envelope;

(d) generating a spline approximation of the approximate envelope using a spline interpolation function and the amplitude values W; and (e) generating an encoder approximation of the signal based on the spline approximation, the set of frequency values V, the number N, the number P and the amplitude values W.

18. The method of claim 17, further comprising:

determining energy levels of the encoder approximation and the signal, respectively; and determining a scaling factor as a function of the energy levels of the encoder approximation and the signal.

19. The method of claim 18, wherein the spline interpolation function is a cubic spline interpolation function.

20. The method of claim 17, wherein step (a) includes:

determining a set of frequency components of the signal by performing a fast Fourier transform thereof, and selecting N largest frequency components of the set of determined frequency components.

21. The method of claim 17, further comprising determining an interval, I, of the signal.

22. The method of claim 21, wherein the samples W are equally spaced in time over the interval I.

23. The method of claim 17, wherein an approximation of the signal x[n] is given by:

$$\hat{x}[n] = \sum_{k \in V} \left( \mathrm{real}(X[k]) \cos\left(\frac{2\pi nk}{I}\right) - \mathrm{imag}(X[k]) \sin\left(\frac{2\pi nk}{I}\right) \right)$$

where X[k] are frequency coefficients of x[n]for k=1, 2, . . . , N; and

I is the interval of the transient audio signal.

24. The method of claim 17, wherein step (b) includes:

determining an absolute value version $x_{abs}[n]$ of the signal x[n]; and low-pass filtering the absolute value version $x_{abs}[n]$ to generate the approximate envelope $x_{env}[n]$.

25. The method of claim 17 wherein N and P are predetermined numbers.

* * * * *